United States Patent [19]

Wallin et al.

[11] Patent Number: 4,965,965

[45] Date of Patent: Oct. 30, 1990

[54] GRINDING HEAD FOR SURFACING AND POLISHING STONE, MARBLES AND OTHER HARD MATERIALS

[76] Inventors: Sven E. Wallin, P.O. Box 9, Älmhult, Sweden, S-343 00; Anders Wallin, Bohusvägen 8, Lund, Sweden, S-222 25

[21] Appl. No.: 372,124

[22] Filed: Jun. 27, 1989

Related U.S. Application Data

[63] Continuation of Ser. No. 216,816, Jul. 8, 1988, abandoned.

[51] Int. Cl.[5] ..... B24B 7/22

[52] U.S. Cl. ..... 51/55; 51/119; 51/283 R; 184/6.18; 384/397

[58] Field of Search ..... 384/397, 398; 184/6.18, 184/39.1

[56] References Cited

U.S. PATENT DOCUMENTS

| | | | |
|---|---|---|---|
| 1,208,278 | 12/1916 | Blecher | 51/55 |
| 2,105,634 | 1/1938 | Brendel | 51/119 |
| 3,609,922 | 10/1971 | Schnizler et al. | 51/119 |
| 4,627,195 | 12/1986 | Greenleaf | 51/109 R |
| 4,646,473 | 3/1987 | Hundebol | 51/90 |
| 4,759,152 | 7/1988 | Berger et al. | 51/119 |

FOREIGN PATENT DOCUMENTS

| | | | |
|---|---|---|---|
| 507230 | 12/1951 | Belgium . | |
| 805989 | 3/1951 | Denmark . | |
| 888516 | 7/1953 | Denmark . | |
| 3100287 | 8/1982 | Denmark . | |
| 3408443 | 9/1984 | Denmark . | |
| 2015385 | 10/1987 | Denmark . | |
| 1115608 | 10/1961 | Fed. Rep. of Germany | 51/119 |
| 1273100 | 10/1960 | France . | |
| 476139 | 11/1975 | U.S.S.R. | 51/119 |
| 531876 | 1/1941 | United Kingdom . | |

*Primary Examiner*—Frederick R. Schmidt
*Assistant Examiner*—Jack Lavinder
*Attorney, Agent, or Firm*—Merchant, Gould, Smith, Edell, Welter & Schmidt

[57] ABSTRACT

Grinding head for surfacing and polishing stone, marbles and other hard materials including a rotating housing supporting a number of oscillating grinding blocks which during rotation of said housing are pressed against the surface to be treated during simulataneous supply of water to the working zone of said grinding blocks. The apparatus includes a new excenter mechanism for imparting to said grinding blocks an oscillatory tangential movement with respect to said grinding head during rotation thereof. The apparatus also renders possible a forced self-lubrication of bearing surfaces.

12 Claims, 2 Drawing Sheets

Figure 3:
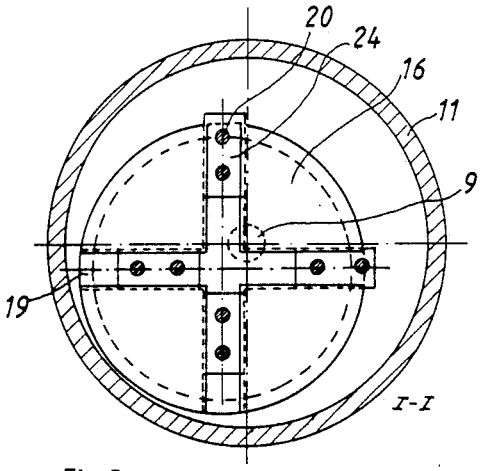

GRINDING HEAD FOR SURFACING AND POLISHING STONE, MARBLES AND OTHER HARD MATERIALS

This is a continuation of Ser. No. 216,816, filed July 8, 1988, now abandoned.

The present invention relates to machines for surfacing and polishing stone, marbles and other hard materials in the form of block, plates or sheets, and is particularly concerned with apparatus of this kind which are provided with a mechanism for causing the rubbing or grinding tools to execute a combination of different movements on the surface of the piece of stone to be polished or surfaced.

Apparatuses for surfacing or polishing stones etc usually include a rotating grinding head comprising a cylindrical disk having mounted thereon a number of rubbing or grinding blocks which during rotation of the disk are pressed against the surface to be treated during simultaneous supply of water to the working zone of the grinding blocks. The grinding blocks are provided with a grinding portion comprising diamond grains or other abrasive grains, the abrasive effect being obtained by moving said grinding block or blocks over a surface to be polished and at the same time pressing the grinding block against said surface.

In the most simple apparatuses of this kind, the grinding surface of the grinding blocks is plain, said blocks being rigidly or rotatably attached to the grinding head. One serious disadvantage inherent in this design is that dirt and mud will collect underneath and in front of the grinding blocks, thus tending to clog the pores of the grinding blocks, thereby preventing accurate grinding action of said grinding blocks.

It has been found that the disadvantage mentioned above can be eliminated if the grinding blocks, in addition to being rotated about the rotational axis of the grinding head, also are made to move with respect to the grinding head. This relative movement may include different types of movement. The grinding blocks may thus be made to rotate about any additional axis, they may be made to perform an oscillating movement in the radial or in the tangential direction with respect to the grinding head. In such cases the grinding blocks are designed so as to provide linear contact between the grinding blocks and the surface to be treated, which results in increased pressure against the surface and improved grinding action. This also results in that the grinding blocks will be kept clean due to the fact that mud and grinding dust formed due to the grinding action, is discharged radially under the influence of the centrifugal forces instead of clogging the abrasive surface of the grinding blocks.

Known apparatuses of this kind usually include a grinding head provided with a number of grinding blocks, e.g. four grinding blocks, which are supported at the ends of arms which are swingably mounted on axis extending radially with respect to the grinding head. Said arms are shaped as double-armed levers, the opposite end of which cooperating with a cam mechanism which is supported by the grinding head and during rotation of the grinding head is caused to rotate at a different rotational speed than the rotational speed of the grinding head. Due to the relative rotational movement between the grinding head and the cam mechanism, the arms, supporting the grinding blocks at the ends thereof, are caused to perform a swinging or oscillating movement about said radially extending axis. The grinding head is driven by means of an electric motor via a transmission gear, thus driving the grinding head and the cam mechanism at different rotational speeds. Known grinding heads of this kind may include two, four or six grinding blocks, the grinding head having a diameter of 200–600 mm and being driven for rotation with a rotary speed of 200–600 r/min. Each grinding block may e.g. be made to perform one full oscillation for every fifteen rotations of the grinding head.

Even if known grinding heads for surfacing stone etc including a cam mechanism of the kind mentioned above provide a satisfactory oscillatory movement to the grinding blocks, an important disadvantage is that the mechanism is subjected to heavy mechanical wear resulting in high maintenance and servicing costs and in a short lifetime of the apparatus.

The object of the present invention is to provide a grinding head for surfacing or polishing stone, marbles, etc of the kind mentioned initially, including a mechanism for oscillating the grinding blocks, in which the disadvantages of the known apparatuses discussed above are eliminated or decreased to a considerable extent, and in which said mechanism for generating said oscillations has a simple design and is less space consuming the previously known mechanisms for this purpose, thus rendering possible an increased number of grinding blocks that may be supported by the grinding head. Another object of the present invention is to provide a grinding head of the kind mentioned which in a simple manner renders possible forced self-lubrication of the movable parts of the apparatus. Still another object of the present invention is to provide a grinding head of the kind mentioned in which the magnitude of the oscillatory movement of the grinding blocks may be adjusted.

These and other objects of the invention are obtained by designing an apparatus for surfacing and polishing of stone, marbles etc in accordance with the features specified in the appended claims.

Figure 1:
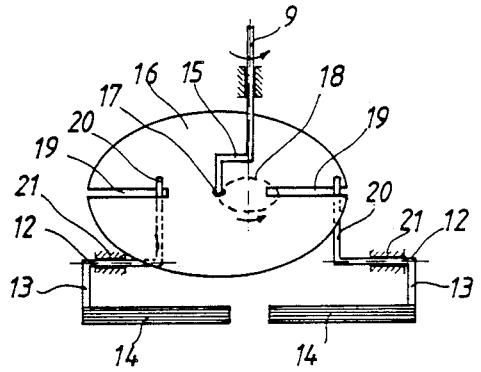
Figure 2:
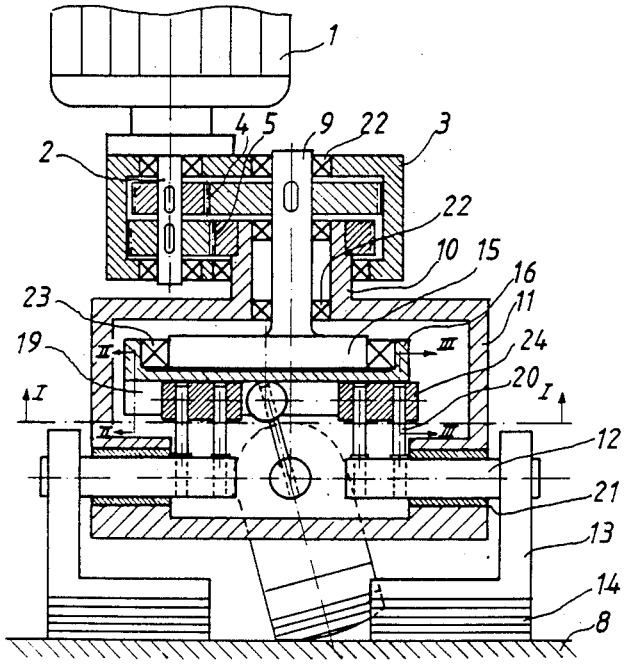
Figure 4:
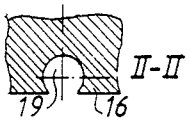
Figure 5:
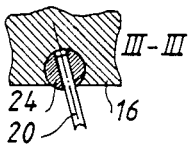
Figure 7:
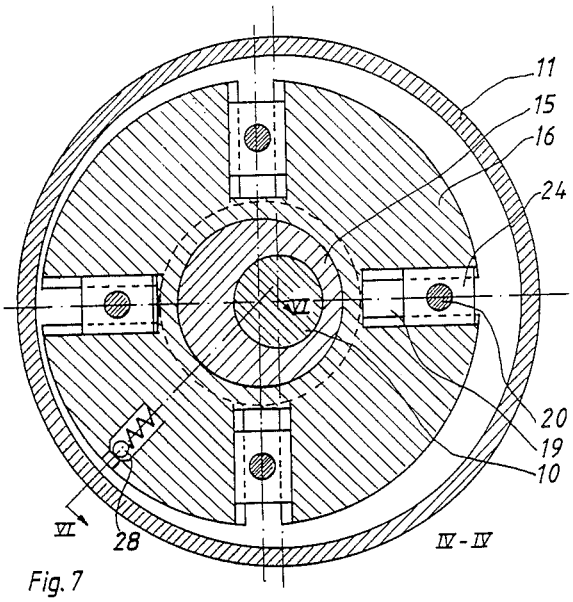
Figure 9:
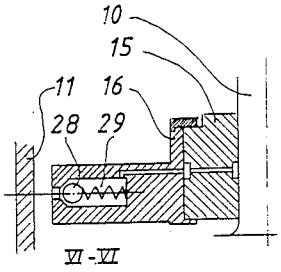
Figure 10:
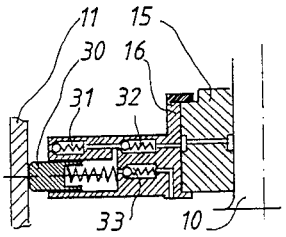
Figure 6:
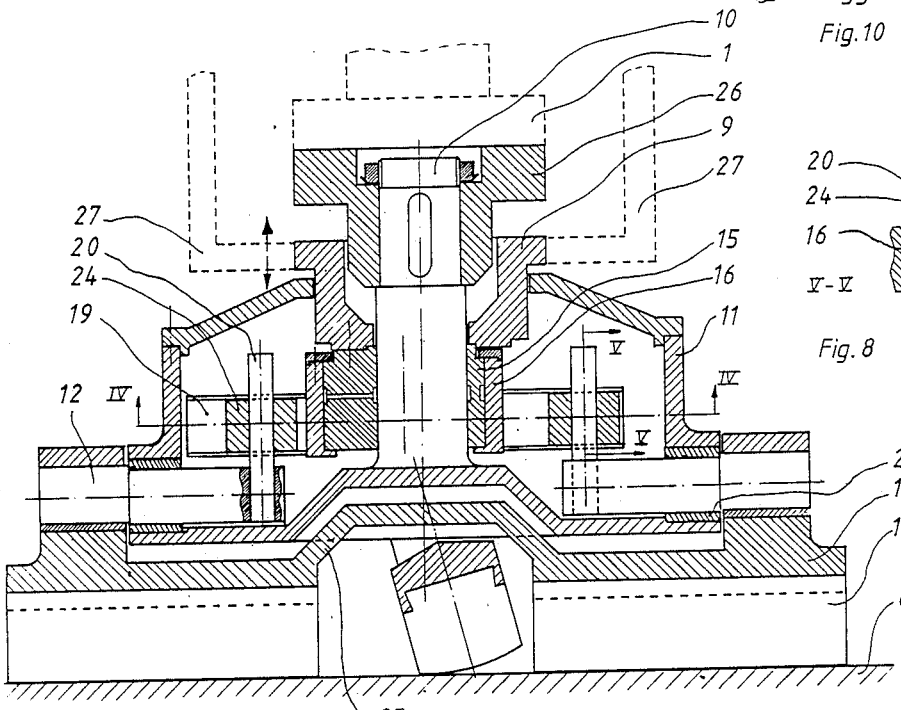
Figure 8:
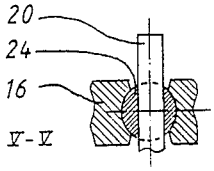

The invention will be described below with reference to embodiments illustrated on the enclosed drawings, of which FIG. 1 very schematically illustrates the principle used according to the present invention for imparting an oscillatory movement to the grinding blocks, FIG. 2 is a schematic vertical section through a first embodiment according to the invention, FIG. 3 is a sectional view taken along line I—I of FIG. 2, FIG. 4 and FIG. 5 are cross sections taken as designated by II—II and III—III respectively in FIG. 2, FIG. 6 is a vertical sectional view of another embodiment according to the invention, FIG. 7 is a sectional view taken as marked by arrows IV—IV in FIG. 6, and FIG. 8 is a sectional view taken as marked by arrows V—V in FIG. 6, FIG. 9 is a sectional view taken along lines VI—VI of FIG. 6, schematically illustrating an arrangement forced self-lubrication, FIG. 10 is a sectional view corresponding to the sectional view illustrated in FIG. 9, and schematically illustrating an alternative embodiment including a piston assembly for providing self-lubrication.

As mentioned previously one object of the invention is to provide a simple mechanism for imparting an oscillatory movement to the grinding blocks of an apparatus for surfacing or polishing stone, marbles etc.

FIG. 1 very schematically illustrates the principles used when designing said mechanism. For full understanding of the following explanation of the principle illustrated in FIG. 1, reference is also made to FIGS. 2-5, since all reference numerals referred to are not indicated in FIG. 1, but may be found in FIGS. 2-5.

FIG. 1 discloses two grinding blocks 14 disposed opposite each other and in line with each other. Each grinding block 14 is rigidly attached to an arm 13 extending in direction upwards and being attached at the opposite end to a shaft 12 extending in parallel with, and at a certain distance above said block 14. Each shaft 12 is journalled in a bearing 21, rigidly supported by a housing 11, not shown in FIG. 1. Rigidly attached to the opposite end of each shaft 12 is a guiding rod 20 extending from said shaft 12 in direction upwards through an elongated slot 19 in a circular disk 16, excentrically disposed inside the housing 11. Said disk 16 is supported in said housing by means of a vertical drive shaft 9 disposed centrally in said housing and supported in the upper part thereof by means of a bearing providing radial as well as axial support. Disk 16 is attached to said drive shaft by means of an excenter 15, which is rotatably supported in a bearing in the central part of said disk. In FIG. 1 said excenter is illustrated as a crank web rotatably attached to the center point 17 of said disk. Supposing that the housing 11 and bearings 21 are held stationary, a rotation of shaft 9 as indicated by the arrow in the upper part of FIG. 1, will cause the center point 17 of disk 16 to move along a circular path 18 indicated in FIG. 1 by a broken circular line. Since the disk 16 according to the invention is prevented from rotating with respect to the housing 11, each and every point or part of said disk is caused to follow a corresponding circular path as the central point 17. This means that also the slots 19 in the disk 16 will move along a corresponding circular path thus imparting to guide rod 20 a tilting or oscillating movement between two angular positions.

In grinding heads for surfacing or polishing of the kind mentioned initially, the housing 11 is not held stationary but instead is driven for rotation about the same rotational axis as shaft 9. It should be appreciated that if housing 11 and shaft 9 are driven for rotation in the same rotational direction and with the same angular speed, no tilting or oscillating action will be imparted to the grinding blocks 14. The grinding head according to the present invention, however, is driven so that a relative rotational movement between the housing 11 and the shaft 9 is obtained, and due to this said oscillating movement is imparted to the grinding blocks.

The invention is described below with reference to FIGS. 2-5 schematically illustrating a first embodiment according to the invention, incorporating the principles explained above with reference to FIG. 1.

The surfacing or polishing machine illustrated in FIGS. 2-5 comprises a grinding head 11 formed as a generally cylindrical housing having a cylindrical wall and top and bottom walls. Four grinding elements in the form of grinding blocks 14 are mounted in bearings 21 in the bottom portion of the grinding head 11. The grinding blocks 14 extend radially with respect to the grinding head 11 and are each at the outer end via a mounting attached to an arm 13 extending in direction upwards. The upper end of each of said arms 13 is attached to a horizontal shaft 12 extending radially into the housing of the grinding head 11 through bearings 21. As clearly visible in FIG. 2 said shafts 12 extend beyond said bearings 21 a certain distance radially into the housing of the grinding head 11. The grinding blocks are thus swingably mounted in bearings 21 permitting a tilting or oscillating movement of the grinding blocks.

The upper wall of the housing of the grinding head 11 is provided with a central, tubelike neck portion forming a shaft 10, which is mounted in a bearing in the bottom wall of a gear box 3 disposed at a short distance above the grinding head 11. Said shaft 10 thus extends into the housing of the gear box and is at the upper end attached to a transmission gear 5 including a pinion attached to the driving shaft 2 of an electric drive motor 1 supported on the top wall of the gear box 3. By means of the drive motor 1, the transmission gear 5 and second shaft 10, the grinding head 11 may be driven for rotation with respect to the gear box 3.

The gear box 3 also includes a second transmission gear 4 comprising a pinion attached to the drive shaft 2 of the drive motor 1 and a gear wheel attached to the upper part of a vertical shaft 9. The shaft 9 is mounted in bearings 22 in the top wall of the gear box 3 and internally in the tubular shaft 10 of the grinding head 11 which extends into the gear box 3. The shaft 9 extends into the housing of the grinding head 11 and is rigidly attached to a horizontal excenter disk 15 forming a part of an excenter mechanism which also includes a rotatable second disk 16 which by means of a bearing 23 is rotatably supported by said excenter disk 15. The main portion of the rotatable second disk 16 is disposed underneath said excenter disk 15 and is provided with four generally cylindrical, horizontal guiding channels 19 extending radially from the perifery of said rotatable second disk. A cylindrical guiding piece 24 is mounted in each of said guiding channels 19 for displacement along said guiding channel 19 in the radial direction of the rotatable second disk 16. Each guiding piece 24 is by means of two cylindrical rods 20 connected to a shaft 12 of a grinding block 14. Said rods 20 are rigidly attached to the shaft 12 and are slidably received in cylindrical borings in said cylindrical guiding piece 24 in order to transmit the movement of the rotational second disk 16 to the shaft 12 so as to impart a tilting or oscillatory movement to the corresponding grinding block 14. This means that each cylindrical guiding piece 24 also will perform an oscillatory rotating movement in the guiding channel 19 between two angular positions. By using two cylindrical rods 20 which are spaced apart in the radial direction, the rotatable second disk 16 is prevented from performing a rotational movement with respect to the housing 11. With respect to the form of the guiding channel 19 and to the connection between the rods 20 and guiding piece 24 reference is made to FIGS. 4 and 5.

As described previously the gear box 3 includes a first transmission gear 5 an a second transmission gear 4, the first one 5 for rotatably driving the grinding head 11 and the second one 4 for rotatably driving the shaft 9 and the associated excenter mechanism 15, 16. The transmission gears 4 and 5 have different gear ratios. In the embodiment illustrated in FIG. 2 the grinding head 11 is driven at a higher angular speed than shaft 9 and the associated excenter mechanism 15, 16.

When using the apparatus for surfacing or polishing the surface of an object, the apparatus is positioned on the surface of said object, the driving motor 1 is actuated and the entire apparatus is then made to move over said surface at the same time being pressed against said surface. Of course the apparatus may be stationary and the object to be treated is then moved in contact with the grinding blocks of the apparatus. Due to the fact that the grinding head 11 including said grinding blocks 18 is driven for rotation at an angular speed which differs from the angular speed of the excenter mechanism 15, 16 the grinding blocks 18 are caused to perform an oscillatory movement between two opposite angular positions at the same time as the grinding head is rotated, in the manner described previously with reference to FIG. 1. The angular speed of the oscillations of the grinding blocks correspond to the difference between the angular speeds of shafts 9 and 10.

In the embodiment illustrated in FIG. 2 the drive motor 1 is directly driving shaft 2. It should be obvious that the drive motor 1, or other driving unit instead may be connected to the shaft 9 for directly driving the excenter mechanism 15, 16.

FIGS. 6–10 illustrate another embodiment of an apparatus according to the invention. The main differences between the apparatus previously described and the apparatus according to FIGS. 6–10 are:

(a)—no transmission gear box is included in order to illustrate that the grinding head can work with only one rotating shaft 10 provided that the other shaft 9 is held stationary;

(b)—the magnitude of the oscillating movement of the grinding blocks is adjustable;

(c)—the apparatus is designed so as to permit forced self-lubrication of bearing surfaces of the apparatus;

(d)—to prevent rotation of disk 16 relative to the housing 11, diametrically opposed grinding blocks are rigidly interconnected in pairs.

In FIGS. 6–10 those parts which correspond to parts in FIGS. 2–5 have been given the same reference numerals.

As best seen in FIG. 6 the apparatus comprises a grinding head or grinding housing 11 including a cylindrical side wall and botten and top walls. Four grinding blocks 14 are supported in mountings at the lower portion of the grinding head by means of arms 13 and shafts 12 extending radially into the grinding head 11 and rotatably mounted in bearings 21. The shafts 12 extend radially into the housing 11 a certain distance beyond the inner ends of the bearings 21. The mountings for the grinding blocks 14 are rigidly interconnected in pairs by means of interconnecting bars 25 extending diametrically underneath the grinding head 11 and being designed so as not to interfere with each other during the tilting movement of the pair of grinding blocks. One of the interconnecting bars thus extends straight between two grinding blocks situated opposite each other, whereas the other interconnecting bar 25 is bent upwards and then back again so as to form a bow in order to avoid interference between the two interconnecting bars.

A driving shaft 10 is rigidly attached at the inside central portion of the bottom of the grinding housing 11. The drive shaft 10 extends in the vertical direction through and beyond the top wall of the housing 11. The shaft 10 thus extends a certain distance outside the grinding head 11 and is provided at the end with a connecting flange 26 for connecting the drive shaft to a corresponding connecting flange at the end of the drive shaft of an drive motor 1 not shown in the figure.

An excenter mechanism is mounted inside the housing 11, said excenter mechanism comprising an inner excenter disk 15 rotatably mounted on the drive shaft 10 in a plane above the shafts 12 of the grinding block 14. An outer disk 16 is rotatably supported by said excenter disk 15 and is provided with four generally cylindrical, guiding channels 19 extending radially from the periphery of said disk 16 in the radial direction thereof. A cylindrical guiding piece 24 is mounted in each of said guiding channels for displacement along the guiding channel 19 in the radial direction of said disk 16. The cylindrical guiding pieces 24 may also be subject to a certain rotation about the center axis of the guiding channel. Each guiding channel 19 is open at the top as well as at the bottom portions thereof as shown in FIG. 8, so that a cylindrical rod 20, which is attached with one end to the shaft 12, is allowed to extend in a direction upwards through a diametrical boring in the guiding piece and further upwards a certain distance beyond the upper surface of the disk 16. This cylindrical rod 20 thus interconnects the guiding piece 24 with shaft 12 and is slidably received in the guiding piece 24 and protrudes in direction upwards in the housing 11.

In this preferred embodiment according to the invention the excenter mechanism 15, 16 is adjustable in the vertical direction and the inner excenter disk 15 is held stationary. The inner excenter disk 15 is attached to a cylindrical hollow shaft 9 extending through the top wall of housing 11. The cylindrical shaft 9 extends a certain distance outside the top wall of the housing 11 and may by means of any suitable adjustment means be displaced a certain distance in the vertical direction, thus also adjusting the position of the excenter mechanism in the vertical direction. The object of this vertical adjustment is to determine the tilting angle of the grinding blocks during the oscillatory movement of said grinding blocks. If the cylindrical shaft 9 and the excenter mechanism 15, 16 is displaced vertically upwards, the distance between the guiding channels 19 and the shafts 12 increases, resulting in a decrease of the tilting angle of the grinding blocks 14. By displacing the excenter mechanism 15, 16 downwards, the tilting angle of the grinding blocks 14 increases.

The cylindrical shaft 9 is prevented from rotation by the stationary arms 27. These arms can also be used for external control of the axial position of disk 16 and thus the tilting angle. The tilting angle can alternatively be set internally by a rotatable lock by means of which the axial distance between the disk 16 and the shafts 12 can be adjusted.

In this preferred embodiment each shaft 12 is connected to its guiding piece 24 in the guiding channel 19 by means of only one cylindrical rod 20. The disk 16 is nevertheless prevented from rotating about its center axis with respect to the grinding head 11 due to the fact, that the mountings for the grinding blocks 14 situated opposite each other are interconnected by means of connection bar 25. This also means that said grinding blocks 14 perform a common oscillatory movement in pairs. The advantage of this compared to the embodiment previously described is that the tangential grinding forces on the interconnected grinding blocks tend to counteract each other, which results in that no or little force is transmitted to the disk 16.

By actuating the electric drive motor the grinding head 11 is rotated about its central axis. The inner excenter disk 16A is held stationary and the disk 16 will move excentrically within the grinding housing 11 along a circular path determined by the excentricity, thus imparting to the pairs of grinding blocks a tilting or oscillatory movement. Each pair of grinding blocks 14 is thus caused to perform one full oscillation for one full revolution of the grinding head. It should be obvious that this grinding head can also be provided with a gear transmission as in FIG. 2, to reduce the number of oscillations per revolution. On the other hand the gear transmission in FIG. 2 can be omitted if shaft 9 is held stationary while shaft 10 is rotated.

It should also be obvious that the shafts 12 may be disposed above the excenter mechanism 15, 16 instead of below said excenter mechanism as illustrated in FIGS. 2 and 6.

In accordance with the present invention the relative movement between the excenter mechanism and the cylindrical wall of the housing of the grinding head 11 may be used for providing a flow of lubricating oil to the bearing surfaces between relative rotatable parts of the apparatus. Such an arrangement is schematically illustrated in FIGS. 7, 9 and 10. As illustrated in FIGS. 7 and 9 the second disk 16 is provided with a radial boring 29 opening into the peripheral surface of said disk via a check valve 28. The radial boring 29 is through oil channels connected with the bearing surfaces between disk 16 and excenter disk 15 and further with the bearing surfaces between excenter disk 15 and shaft 10. Under the influence of a local increase in the pressure in the lubricating oil in the housing 11 obtained when the disk 16 during the excentric movement in the housing approaches the inner wall of said housing, the check valve opens, resulting in a flow of lubricating oil to said bearing surfaces.

FIG. 10 illustrates schematically an alternative embodiment by means of which the distribution of lubricating oil may be obtained. According to this embodiment a plunger 30 is displacable in a cylindrical channel in the disk 16. The plunger 30 is urged in a direction radially outwards partly due to the centrifugal force during the rotation, partly under the influence of a spring force. During the relative movement between disk 16 and the housing 11 the plunger is made to perform a reciprocating movement in said radial cylindrical channel. By means of small channels in the disk 16 the space inside the plunger 31 is connected to the interior of housing 11 via a check valve 31. Said space inside the plunger 30 is further connected with bearing surfaces via another check valve 32 and small oil channels. When the plunger 30 under the influence of the relative movement between the housing 11 and the disk 16 is displaced radially outwards, oil is sucked into the space behind the plunger 30 via check valve 31. When the plunger 30 during said continued relative movement is displaced radially inwards, oil is supplied to the bearing surfaces via check valve 32 and said oil channels. The housing 11 is normally partially filled with lubricating oil which, due to the influence of centrifugal forces tends to collect in the peripheral portions of said housing. Due to the pumping effect of said plunger 30 lubricating oil will still be forced to flow radially inwards to the bearing surfaces for lubricating said bearings. The cylindrical channel in which the plunger 30 is reciprocating may also be connected with the interior of the housing 11 via a safety valve 33.

We claim:

1. Grinding head for surfacing or polishing stone, marbles and other hard materials, comprising:

a housing having a central main drive shaft, by means of which said housing is being rotated, a number of shafts extending radially into said housing and rotatably mounted therein, each shaft being rigidly attached to a downward depending arm provided with a grinding block at the end thereof, an eccentric mechanism mounted in said housing, said eccentric mechanism comprising a circular eccentric disk eccentrically attached to a second shaft extending into the housing concentrically with said main drive shaft, and a second disk rotatably mounted on said circular excenter disk for relative rotational movement between said disks about the central axis of said circular eccentric disk, rigid connection means attached to each one of said radially extending shafts and cooperatively engaging said eccentric mechanism or imparting a swinging movement to each of said arms provided with grinding blocks, upon relative rotational movement between said main drive shaft and said second shaft, said second disk being provided with a number of radially extending guiding channels corresponding to the number of shafts extending radially into said housing, said guiding channels slidably receiving said rigid connection means, said second disk being prevented from rotating with respect to said housing upon relative rotational movement between said main drive shaft and said second shaft.

2. Grinding head as claimed in claim 1, wherein each of said guiding channels extending radially in said second disk is open at the side thereof facing the corresponding shaft extending radially into, the housing, for permitting the entrance of said rigid connection means into said channel.

3. Grinding head as claimed in claim 2, wherein each of said guiding channels is formed as a radially extending, generally cylindrical channel in which a cylindrical guiding piece is slidably and rotatably received, said rigid connection means comprising at least one cylindrical rod slidably received in a transversal boring in said cylindrical guiding piece.

4. Grinding head as claimed in claim 3, wherein said rigid connection means includes two parallel cylindrical rods spaced apart in the radial direction and received in corresponding transversal borings in said cylindrical guiding piece, thereby preventing relative rotation between said second disk and said housing.

5. Grinding head as claimed in claim 3, wherein two radially extending shafts situated diametrically opposite each other are interconnected so as to move in common, thereby preventing relative rotation between said second disk and said housing.

6. Grinding head as claimed in claim 3 wherein the cylindrical guiding pieces received in cylindrical guiding channels disposed diametrically opposite each other, are interconnected so as to move in common, thereby preventing relative rotation between said second disk and said housing.

7. Grinding head as claimed in claim 1, wherein each one of said guiding channels extending radially in said second disk is open on the side thereof facing the corresponding shaft extending radially into the housing, as well as on the opposite side of said guiding channel, thus permitting said rigid connection means to extend through said guiding channel into the inner part of said housing.

8. Grinding head as claimed in claim 1, wherein the circular eccentric disk of said eccentric mechanism is displace-ably mounted with respect to said main drive shaft, thereby permitting adjustment of the eccentric mechanism in the axial direction of said housing.

9. Grinding head as claimed in claim 1, wherein the eccentric movement of said eccentric mechanism in the housing is used for providing a forced supply of lubricating oil contained in said housing, to bearing surfaces in the grinding head.

10. Grinding head as claimed in claim 9, wherein the local increase in pressure in said lubricating oil, obtained when said eccentric mechanism during the excentric movement approaches the wall of said housing, is used to provide a supply of lubricating oil to said bearing surfaces.

11. Grinding head as claimed in claim 10, wherein said second disk of the excentric mechanism is provided with at least one oil channel extending from an inner bearing surface of said second disk to the peripheral surface of said second disk and opening into said surface via a check valve adapted to open under the influence of said local increase in the pressure of the lubricating oil.

12. Grinding head as claimed in claim 9, wherein said second disk of said eccentric mechanism is provided with a piston assembly including a piston which during rotation of the grinding head is urged towards the inner wall of the housing and under the influence of relative movement between the excentric mechanism and the inner wall of said housing is forced to act as a lubricating pump supplying lubricating oil to bearing surfaces of the grinding head.

* * * * *